US008418867B2

(12) United States Patent
Ikemiya et al.

(10) Patent No.: US 8,418,867 B2
(45) Date of Patent: Apr. 16, 2013

(54) CONTAINER REFRIGERATION UNIT AND METHOD FOR FABRICATING THE SAME

(75) Inventors: Makoto Ikemiya, Osaka (JP); Takayuki Uo, Osaka (JP); Keiji Tomioka, Osaka (JP); Shouzou Kameyama, Osaka (JP)

(73) Assignee: Daikin Industries, Ltd., Osaka (JP)

( * ) Notice: Subject to any disclaimer, the term of this patent is extended or adjusted under 35 U.S.C. 154(b) by 559 days.

(21) Appl. No.: 12/668,846

(22) PCT Filed: Jul. 7, 2008

(86) PCT No.: PCT/JP2008/001804

§ 371 (c)(1),
(2), (4) Date: Jan. 12, 2010

(87) PCT Pub. No.: WO2009/011099

PCT Pub. Date: Jan. 22, 2009

(65) Prior Publication Data

US 2010/0205999 A1 Aug. 19, 2010

(30) Foreign Application Priority Data

Jul. 13, 2007 (JP) ..... 2007-184223

(51) Int. Cl.
*B65D 88/00* (2006.01)
*F25D 13/02* (2006.01)

(52) U.S. Cl.
USPC ..... 220/1.5; 62/440

(58) Field of Classification Search ..... 220/1.5, 220/592.01; 62/259.1, 440, 498
See application file for complete search history.

(56) References Cited

U.S. PATENT DOCUMENTS

2009/0133420 A1 5/2009 Kitamura et al.

FOREIGN PATENT DOCUMENTS

| | | | |
|---|---|---|---|
| JP | 63-123985 | U | 8/1988 |
| JP | 4-27367 | U | 3/1992 |
| JP | 4-177079 | A | 6/1992 |
| JP | 8-337285 | A | 12/1996 |
| JP | 9-12084 | A | 1/1997 |
| JP | 10-160326 | A | 6/1998 |
| JP | 10-288454 | A | 10/1998 |
| JP | 11-270963 | A | 10/1999 |
| JP | 2002-147944 | A | 5/2002 |
| JP | 2007-93122 | A | 4/2007 |

*Primary Examiner* — Harry Grosso
(74) *Attorney, Agent, or Firm* — Birch, Stewart, Kolasch & Birch, LLP

(57) ABSTRACT

Disclosed is a casing structure by which stiffness of a casing of a container refrigeration unit for cooling the interior of a container can be increased without affecting the arrangement, shape, and maintainability of devices accommodated in the casing.

A container interior side of the external casing (12) which constitutes the casing (11) is provided with flanges (34) which extend vertically and which are located at both end portions of the external casing (12) along a dimension of the container width. Each of the flanges (34) has a rectangular cylindrical portion (34*a*) extending vertically along the external casing (12).

4 Claims, 9 Drawing Sheets

(a)

(b)

CONTAINER REFRIGERATION UNIT AND METHOD FOR FABRICATING THE SAME

TECHNICAL FIELD

The present invention relates to container refrigeration units for cooling the interior of a container, and specifically relates to increasing the stiffness of the casing of the container refrigeration unit.

BACKGROUND ART

Container refrigeration units have been used to provide cooling of the interior of a container for marine transportation, etc.

Patent Document 1 shows an example container refrigeration unit of this type. The container refrigeration unit is located at an opening of a container whose one end is open. That is, the container refrigeration unit has a casing which seals the open end of the container. The casing has, at its lower portion, an external accommodation space which faces the container exterior. A compressor, a condenser, an external fan, etc. are accommodated in the external accommodation space.

The casing also has, at its upper portion, an internal accommodation space which faces the container interior. This internal accommodation space is partitioned from the container interior space by a partition plate. The partition plate is supported by side stays provided at both lateral end portions on the interior side of the casing. Further, an internal fan, an evaporator, etc. are disposed in the internal accommodation space to form an air flow path for the air in the container.

During the operation of the container refrigeration unit, the air in the container is led to the air flow path in the internal accommodation space by the internal fan, and is cooled when it passed through the evaporator. The cooled air flows out from the air flow path, and is returned to the container interior. That is, the container refrigeration unit provides cooling and freezing of the container interior by cooling the air in the container when the air passes through the air flow path and circulating the cooled air.

CITATION LIST

Patent Document

PATENT DOCUMENT 1: Japanese Patent Publication No. 2007-93122

SUMMARY OF THE INVENTION

Technical Problem

According to the container refrigeration unit having the above-described structure, the casing which seals the open end of the container is made of a plate-like member, and therefore, a reinforcing structure is necessary to ensure a certain degree of stiffness. Stiffness in the thickness direction and bending stiffness need to be increased particularly for the above plate-like casing.

One such reinforcing structure may be a diagonal bracing structure including bracing members which extend diagonally and intersect with each other. However, since various devices are disposed in the internal and external spaces of the casing, the provision of the diagonal bracing structure may limit the arrangement and the shape of the devices due to the bracing members, or may limit accessibility to devices disposed in the interior space of the casing, which results in causing maintenance problems.

The present invention was made in view of the above, and its object is to obtain a casing structure by which stiffness of the casing of a container refrigeration unit for cooling the interior of a container can be increased without affecting the arrangement, shape, and maintainability of devices accommodated in the casing.

Solution to the Problem

To achieve the above object, the container refrigeration unit (10) according to the present invention includes reinforcing members (34), each having a vertically extending, rectangular cylindrical portion (34*a*), at both end portions of the container interior side of the external casing (12) along the dimension of the container width. With this structure, stiffness of the external casing (12) can be increased.

The first aspect of the present invention is a container refrigeration unit including an external casing (12) whose periphery is fixed to a container body (1) to close an open end of the container body (1), and an internal casing (13) which covers a container interior side of the external casing (12) such that a foaming agent space (V), in which a foaming agent (60) is foamed, is formed between the external casing (12) and the internal casing (13).

The container interior side of the external casing (12) is provided with reinforcing members (34) which extend vertically and which are located at both end portions of the external casing (12) along a dimension of a container width, and each reinforcing member (34) has a rectangular cylindrical portion (34*a*) extending vertically along the external casing (12).

According to this structure, stiffness of the external casing (12) in the direction orthogonal to the plane can be increased by the rectangular cylindrical portions (34*a*) provided at both end portions of the container interior side of the external casing (12) along the dimension of the container width. This means that, according to the above structure, the strength of the casing (11) can be increased by the rectangular cylindrical portions (34*a*) without providing the casing (11) with a diagonal bracing structure in which bracing members extend diagonally and intersect with each other. Therefore, unlike the case in which the diagonal bracing structure is provided, the arrangement and the shape of devices accommodated in the casing (11) are not limited, and maintenance problems do not occur.

Incidentally, in the case where the container (C) is carried by a ship, a great force in a lateral direction is applied to an upper portion of the container (C) having a box-like shape, and this may deform the container (C) in the shear direction. Thus, before shipment of the container (C), a test is performed in which a force much greater than an actual force is applied to one of corners of the upper portion of the container (C) or two of the corners on the same side of the container (C) to check the strength of the container (C).

Among the strength tests, the test in which a great force is applied to two corners of the upper portion of the container (C) that are on the same side of the container (C) results in a significant displacement of the upper portion of the container (C) in a lateral direction with respect to the lower portion of the container (C), and causes a shear deformation over the entire container (C). This means that a great force in the shear direction is also applied to the casing (11) of the container refrigeration unit (10) which constitutes one of the end faces of the container (C). Thus, if a force in the width direction of the container is applied to the upper portion of the casing (11)

of the container refrigeration unit (10), which is connected and fixed to the end of the container (C), the casing (11) is deformed in the direction orthogonal to the plane (a longitudinal direction of the container) in a wave-like manner.

In this case, great stress acts on part of the casing (11) having a complicated structure in which the external accommodation space (S1) and the internal accommodation space (S2) are provided as described in the above. Thus, a deformation or a small flaw may occur in part of the internal casing (13) made of a resin (FRP), depending on the force applied in the test.

In view of this, according to the second aspect of the present invention, the rectangular cylindrical portion (34*a*) is configured to have a cross section whose length along a longitudinal dimension of the container is longer than a length of the cross section along the width dimension of the container.

With this structure, stiffness of the rectangular cylindrical portion (34*a*) in a longitudinal direction of the container can be increased, and therefore, it is possible to increase the bending stiffness of the casing (11), which is provided so as to close the open end of the container body (1), in a vertical direction. As a result, the internal casing (13) of the casing (11), the internal casing (13) being made of a resin, can be prevented from being damaged by stress partially concentrated on the internal casing (13).

Each reinforcing member (34) has a generally P-shaped cross section in which one side of the rectangular cylindrical portion (34*a*) is elongated, and the reinforcing member (34) is fixed to the external casing (12) such that the elongated side comes in contact with a surface of the external casing (12) on the container interior side (the third aspect of the present invention). With this structure, a wider area of the reinforcing member (34) can come in contact with the external casing (12), and a greater part of the external casing (12) can be reinforced.

It is preferable that the rectangular cylindrical portion (34*a*) is configured such that an injection hose (65) for injecting a foaming agent can be inserted into the rectangular cylindrical portion (34*a*), and a side surface of the rectangular cylindrical portion (34*a*) is provided with through holes (34*d*, 34*e*) which allow the foaming agent (60) to pass through at the time of filling of the foaming agent space (V) with the foaming agent (60) (the fourth aspect of the present invention).

According to this structure, the rectangular cylindrical portion (34*a*) of the reinforcing member (34) can be used as a guide of the injection hose (65) at the time of filling of the foaming agent space (V) with the foaming agent (60), and the rectangular cylindrical portion (34*a*), which it is difficult to fill with the foaming agent (60), can be filled with the foaming agent (60) with reliability. Here, the foaming agent (60) having been charged in the rectangular cylindrical portion (34*a*) is charged in the foaming agent space (V) through the through holes (34*d*, 34*e*) formed in a side surface of the rectangular cylindrical portion (34*a*). Accordingly, the foaming agent space (V) can be filled with the foaming agent (60) with reliability.

A second reinforcing member (38) having a generally L-shaped cross section may be provided at a middle portion of the container interior side of the external casing (12) along the dimension of the container width (the fifth aspect of the present invention). Stiffness of the external casing (12) can be further increased by the provision of the second reinforcing member (38) on the container interior side of the external casing (12). The second reinforcing member (38) having a generally L-shaped cross section allows the foaming agent space (V) to be filled with foaming agent (60) more reliably and easily, compared to the case in which the second reinforcing member (38) has a generally C-shaped or other cross section. In the case where the container (C) is carried by a truck, a great force may be applied to the internal casing (13) and the external casing (12) by goods in the container (C) which have shifted toward the front of the vehicle, i.e., toward the container refrigeration unit, because of such as hard braking. However, the second reinforcing member (38) provided at a middle portion of the container interior side of the external casing (12) along the dimension of the container width can increase the strength of the end wall of the external casing (12).

In a method for forming a container refrigeration unit according to the sixth aspect of the present invention, the foaming agent space (V) between the external casing (12) and the internal casing (13) is filled with the foaming agent (60) using the rectangular cylindrical portion (34*a*) provided, for reinforcement, on the container interior side of the external casing (12), and thereby, the foaming agent space (V) is filled with the foaming agent (60) efficiently and reliably.

Specifically, the sixth aspect of the present invention is a method for forming a container refrigeration unit which includes: an external casing (12) whose periphery is fixed to a container body (1) to close an open end of the container body (1); and an internal casing (13) which covers a container interior side of the external casing (12), and in which a foaming agent space (V) between the external casing (12) and the internal casing (13) is filled with a foaming agent (60), and the foaming agent (60) is foamed.

The method includes: providing the container interior side of the external casing (12) with rectangular cylindrical portions (34*a*) for reinforcement, which extend vertically and which are located at both end portions of the external casing (12) along a dimension of a container width, and each of which has a cross section whose length along a longitudinal dimension of the container is loner than a length of the cross section along the width dimension of the container; inserting an injection hose (65) for injecting a foaming agent into the rectangular cylindrical portions (34*a*) from outside the rectangular cylindrical portions (34*a*), with the external casing (12) and the internal casing (13) attached to each other; and filling the foaming agent space (V) with the foaming agent (60) through the rectangular cylindrical portions (34*a*).

According to this method, rectangular cylindrical portions (34*a*) extending vertically and each having a cross section whose length along a longitudinal dimension of the container is longer than a length of the cross section along the width dimension of the container, are provided at both end portions of the container interior side of the external casing (12) along the dimension of the container width in order to increase the bending stiffness of the casing (11) in a vertical direction. Thus, even if the structure is such that there is not enough space for inserting the injection hose (65) near the rectangular cylindrical portion (34*a*), the injection hose (65) can be inserted into the rectangular cylindrical portion (34*a*), and therefore, the foaming agent space (V) can be filled with the foaming agent (60) through the rectangular cylindrical portion (34*a*). In addition, the rectangular cylindrical portion (34*a*) can be used as a guide of the injection hose (65). Therefore, the injection hose (65) can be placed at a predetermined location in the foaming agent space (V) with reliability. Moreover, as described in the above, the rectangular cylindrical portion (34*a*), which it is difficult to fill with the foaming agent (60), is filled with the foaming agent (60) first, and therefore, the foaming agent space (V) can be filled with the foaming agent (60) with no space left in the foaming agent space (V).

According to the above-described method, it is preferable that, to fill the foaming agent space (V) with the foaming agent (60), the foaming agent (60) is injected into the foaming agent space (V), with the external casing (12) and the internal casing (13) tilted such that a side opposed to a side from which the injection hose (65) is inserted is placed in a lower location than the side from which the injection hose (65) is inserted (the seventh aspect of the present invention).

According to this method, the foaming agent (60) having been injected through the injection hose (65) into the foaming agent space (V) located between the external casing (12) and the internal casing (13) flows, due to gravity, to the side opposed to the side from which the hose is inserted, because the opposite side is placed in a lower location than the hose insertion side. Thus, the foaming agent space (V) is filled with the foaming agent (60) from the side opposite to the hose insertion side. By this method, the foaming agent space (V) can be thoroughly and more reliably filled with the foaming agent (60).

Advantages of the Invention

According to the first aspect of the present invention, the container interior side of the external casing (12), which is fixed to the container body (1) so as to close the open end of the container body (1), is provided with the reinforcing members (34) having the rectangular cylindrical portions (34*a*) which extend vertically and which are located at both end portions of the external casing (12) along the dimension of the container width. With this structure, stiffness of the casing (11) can be increased. Thus, unlike the case in which the diagonal bracing structure is used, the stiffness of the casing (11) can be increased without limiting the arrangement and the shape of devices accommodated in the casing (11) and without maintenance problems.

According to the second aspect of the present invention, the rectangular cylindrical portion (34*a*) has a cross section whose length along a longitudinal dimension of the container is longer than a length of the cross section along the width dimension of the container. Therefore, stiffness of the rectangular cylindrical portion (34*a*) in the longitudinal direction of the container can be increased. As a result, the bending stiffness of the casing (11) in the vertical direction can be increased. Thus, even in the case where a great force is applied, for example, to two corner portions on the same side of the container (C), the internal casing (13) made of a resin can be prevented from being damaged by the great stress partially concentrated on the internal casing (13).

According to the third aspect of the present invention, each reinforcing member (34) has a generally P-shaped cross section in which one side of the rectangular cylindrical portion (34*a*) is elongated, and the reinforcing member (34) is fixed to the external casing (12) such that the elongated side comes in contact with a surface of the external casing (12) on the container interior side. Therefore, a greater part of the external casing (12) can be reinforced by the reinforcing members (34).

According to the fourth aspect of the present invention, the rectangular cylindrical portion (34*a*) is configured such that an injection hose (65) for injecting a foaming agent can be inserted into the rectangular cylindrical portion (34*a*), and a side surface of the rectangular cylindrical portion (34*a*) is provided with through holes (34*d*, 34*e*) which allow the foaming agent (60) to pass through at the time of filling of the foaming agent space (V) with the foaming agent (60). With this structure, the injection hose (65) can be easily inserted to a predetermined location in the foaming agent space (V), using the rectangular cylindrical portion (34*a*) as a guide. Moreover, the rectangular cylindrical portion (34*a*), which it is difficult to fill with the foaming agent (60), can be filled with the foaming agent (60) first, and then, the foaming agent space (V) can be reliably filled with the foaming agent (60) through the through holes (34*d*, 34*e*). Thus, according to the above structure, the foaming agent space (V) can be filled with the foaming agent (60) more easily, and the foaming agent space (V) can be filled with the foaming agent (60) efficiently and reliably.

According to the fifth aspect of the present invention, a second reinforcing member (38) having a generally L-shaped cross section is provided at a middle portion of the container interior side of the external casing (12) along the dimension of the container width. Therefore, stiffness of the external casing (12) can be further increased, and interruption of the flow of the foaming agent (60) in the foaming agent space (V) by the second reinforcing member (38) can be prevented. As a result, the foaming agent space (V) can be efficiently filled with the foaming agent (60). Specifically, strength of the end wall of the container (C) can be increased by the second reinforcing member (38) provided at a middle portion of the container interior side of the external casing (12) along the dimension of the container width.

According to the sixth aspect of the present invention, the container interior side of the external casing (12), which is fixed to the container body (1) to close the open end of the container body (1), is provided with the reinforcing members (34) having rectangular cylindrical portions (34*a*) which extend vertically and which are located at both end portions of the external casing (12) along the dimension of the container width, and each of which has a cross section whose length along a longitudinal dimension of the container is longer than a length of the cross section along the width dimension of the container. The injection hose (65) is inserted into the rectangular cylindrical portion (34*a*) from the outside to fill the foaming agent space (V) with the foaming agent (60). Thus, even in the case where there is not enough space for inserting the injection hose (65) near the rectangular cylindrical portion (34*a*), the injection hose (65) can be inserted into the foaming agent space (V) to a predetermined location, using the rectangular cylindrical portion (34*a*) as a guide. Therefore, the foaming agent space (V) can be efficiently filled with the foaming agent (60). In addition, the rectangular cylindrical portion (34*a*), which it is difficult to fill with the foaming agent (60), is filled with the foaming agent (60) first. Therefore, the foaming agent space (V) can be thoroughly and reliably filled with the foaming agent (60).

According to the seventh aspect of the present invention, the external casing (12) and the internal casing (13) are tilted at the time of the injection of the foaming agent (60) into the rectangular cylindrical portion (34*a*) such that the side opposed to the side from which the injection hose (65) is inserted is placed in a lower location than the hose insertion side. Therefore, the foaming agent space (V) can be thoroughly and efficiently filled with the foaming agent (60).

DESCRIPTION OF REFERENCE CHARACTERS

Figure 1:
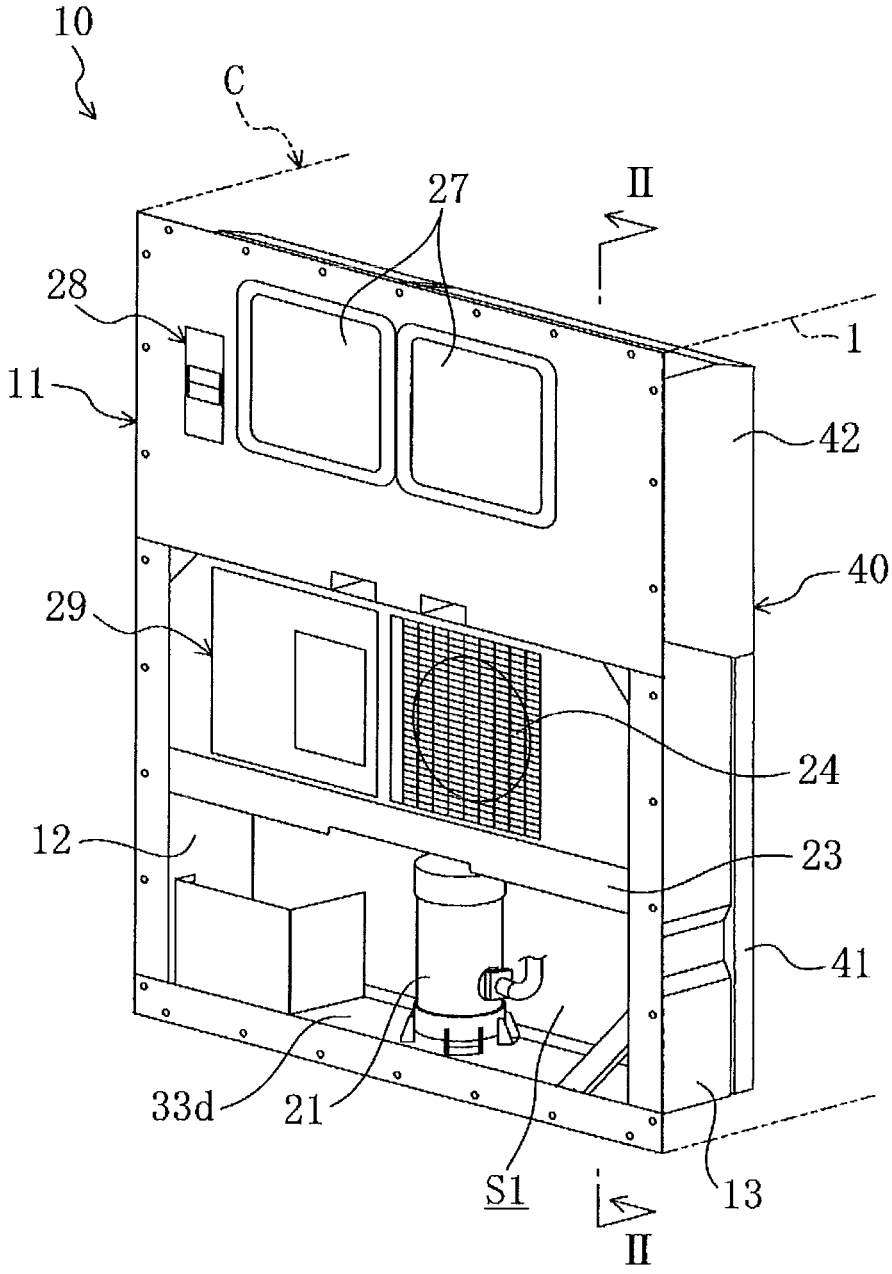
FIG. 1 is an oblique view of a container refrigeration unit according to the present embodiment, viewed from a container exterior side.

10 Container refrigeration unit
11 Casing
12 External casing
13 Internal casing
34 Flange (Reinforcing member)
34*a* Rectangular cylindrical portion
34*b* Flap portion
34*c* Interior space
34*d*, 34*e* Through holes
38 L-shaped reinforcing member (second reinforcing member)
60 Foaming agent
61 First injection opening
65 Injection hose
C Container
V Foaming agent space

DESCRIPTION OF EMBODIMENTS

An embodiment of the present invention will be described in detail hereinafter based on the drawings. Essentially, the following descriptions of a preferable embodiment are merely examples which are not intended to limit the present invention, its application, or its range of use.

A container refrigeration unit (10) of the present embodiment provides cooling or freezing of the interior of the container (C) used for marine transportation, etc., and is disposed so as to seal the open end of the container body (1) having a cylindrical shape whose one end is closed. More specifically, the casing (11) of the container refrigeration unit (10) is fastened and fixed to the open end of the container body (1) with a plurality of bolts.

The container refrigeration unit (10) has a refrigerant circuit (not shown). That is, the container refrigeration unit (10) is configured to provide cooling of the air inside the container (C), using a refrigeration cycle of the refrigerant circuit. The general structure of the container refrigeration unit (10) will be described below.

<General Structure of Container Refrigeration Unit>

Figure 2:
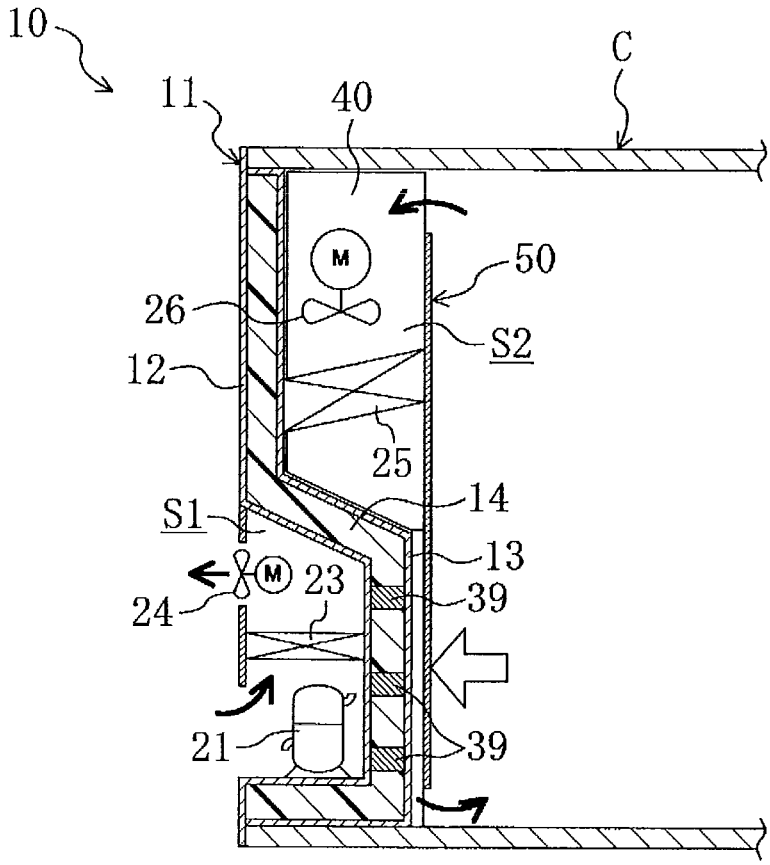
FIG. 2 is a cross-sectional view taken along the line II-II of FIG. 1.

As shown in FIG. 1 and FIG. 2, the container refrigeration unit (10) has a casing (11) whose periphery is attached to the container body (1) to close the open end of the container body (1) having a cylindrical shape whose one end is closed. A lower portion of the casing (11) protrudes into the interior of the container (C). This forms an external accommodation space (S1) at the lower portion of the casing (11) on the exterior side of the container, and an internal accommodation space (S2) at an upper portion of the casing (11) on the interior side of the container.

A compressor (21), a condenser (23), an external fan (24), etc. are accommodated in the external accommodation space (S1). The compressor (21) and the condenser (23) are connected to the refrigerant circuit (not shown). The external fan (24) draws air outside the container into the external accommodation space (S1) and transfers the air to the condenser (23). The condenser (23) is configured to exchange heat between the air outside the container and a refrigerant. That is, the external accommodation space (S1) constitutes an external air flow path.

Figure 3:
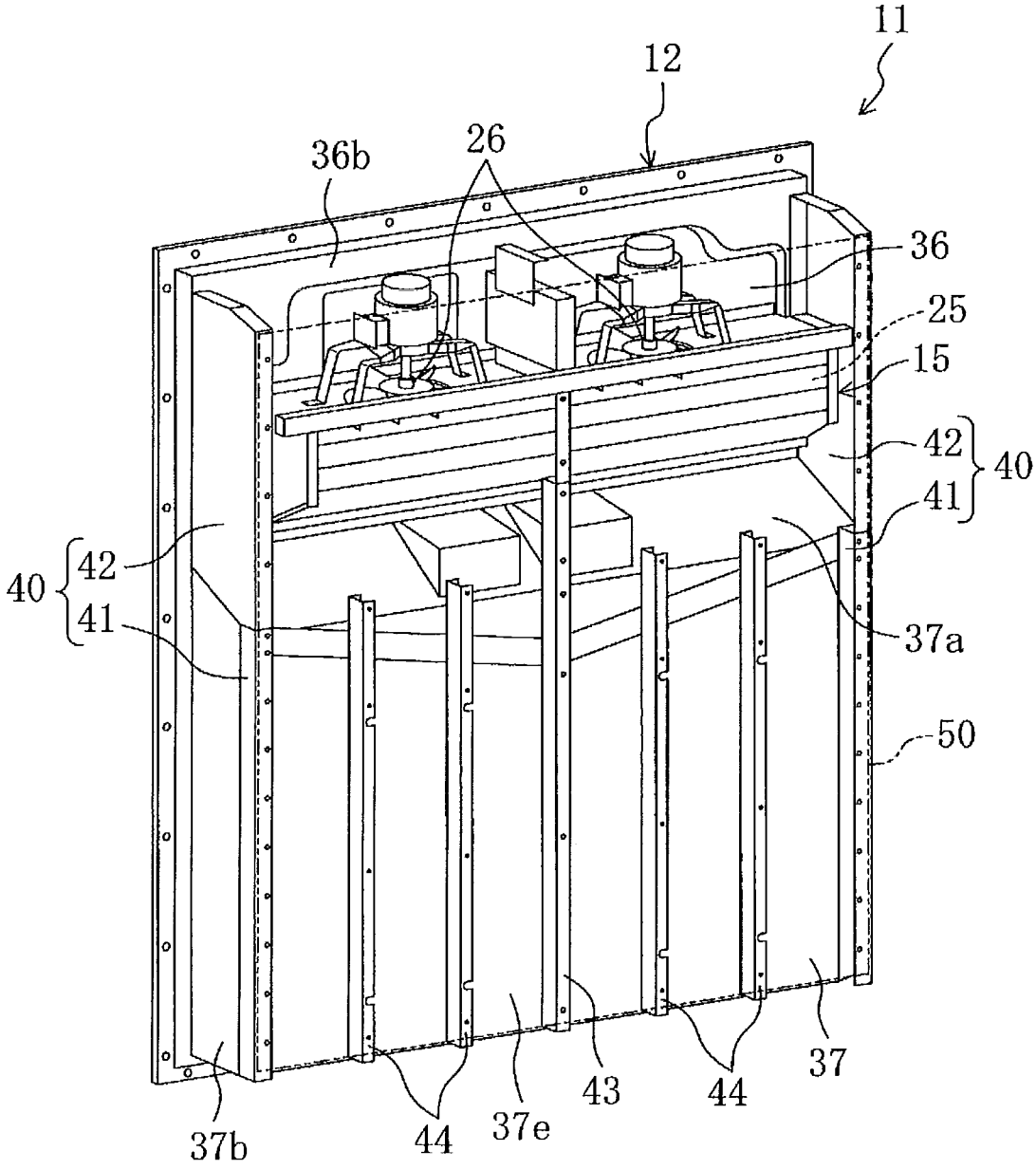
FIG. 3 is an oblique view of the container refrigeration unit without a partition plate, viewed from a container interior side.

As shown in FIG. 2 and FIG. 3, a partition plate (50) supported by side stays (40), a frame support member (43), and partition plate support members (44, 44, . . . ) is disposed on the container interior side of the casing (11). This partition plate (50) separates the interior of the container (C) and the internal accommodation space (S2) from each other. The partition plate (50) is disposed such that space is left between the partition plate (50) and each of the top and bottom inner surfaces of the container body (1) (see FIG. 2).

An evaporator (25) and interior fans (26) are accommodated in an upper portion of the internal accommodation space (S2) on the container interior side of the casing (11). Like the condenser (23), this evaporator (25) is also connected to the refrigerant circuit (not shown). The interior fans (26) draw air inside the container (C) through the space above the partition plate (50), and transfer the air to the evaporator (25). The evaporator (25) exchanges heat between the air inside the container (C) and a refrigerant, and the air is returned to the container interior through the space below the partition plate (50) by the interior fans (26). The internal accommodation space (S2) therefore constitutes an internal air flow path.

As shown in FIG. 3, an evaporator holding frame (15) for holding the interior fans (26) and the evaporator (25) is provided in an upper portion of the casing (11) on the container interior side. The evaporator holding frame (15) is configured to support the interior fans (26) at a location above the evaporator (25) so that the air inside the container (C) can flow downward from above the evaporator (25) by the interior fans (26). One side of an extension plate (42, 42), which constitutes an upper portion of the side stay (40, 40), is connected to a lateral end of the evaporator holding frame (15). Further, the lateral center portion of the evaporator holding frame (15) is connected to the upper end of the frame support member (43) which is fixed to the container interior side of the lateral center portion of the casing (11) and which extends vertically.

The side stays (40) are fixed to the container interior side of the casing (11). Specifically, each side stay (40) has a column portion (41) connected to the lower portion of the casing (11) that protrudes into the container interior, and has the extension plate (42) placed on the column portion (41) and connected to the upper end of the column portion (41) and to the upper portion of the casing (11).

Thus, the both lateral ends of the evaporator holding frame (15) are supported by the side stays (40), and the lateral center portion of the evaporator holding frame (15) is supported by the frame support member (43).

Each of the frame support member (43) and the partition plate support members (44) is a column-like member whose cross section is generally C-shaped, and the frame support member (43) is longer than the partition plate support members (44). The frame support member (43) is located at the lateral center portion of the lower portion of the casing (11) on the container interior side so as to extend vertically. The partition plate support members (44) are arranged approximately parallel with the frame support member (43) on both lateral sides of the frame support member (43). The frame support member (43) and the partition plate support members (44) are attached to the container interior side of the casing (11) such that each of the frame support member (43) and the partition plate support members (44) is open toward the same direction along the width dimension of the container (in FIG. 3, toward the right).

As mentioned in the above, the partition plate (50) for separating the internal accommodation space (S2) and the interior of the container (C) is connected and fixed to the side stays (40), the frame support member (43), and the partition plate support members (44). Due to this structure, a load applied to the partition plate (50) is transferred to the casing (11) through the side stays (40), the frame support member (43), and the partition plate support members (44), as described in detail later.

As shown in FIG. 1, the casing (11) has, at its upper portion, a view window (27) provided with an openable door used during maintenance, and has a ventilator (28). The ventilator (28) constitutes a ventilation device for ventilating air inside the container. Further, an electrical component box (29) is disposed at a location close to the external fan (24) in the external accommodation space (S1) of the casing (11).

As shown in FIG. 2, the casing (11) has an external casing (12) located on the container exterior side, and an internal casing (13) located on the container interior side. The external casing (12) is made of an aluminum alloy, and is attached to the periphery of the container body (1) so as to close the end face of the container body (1). The internal casing (13) is made of a fiber-reinforced plastic (FRP), and is attached such that it covers the container interior side of the external casing (12).

Figure 4:
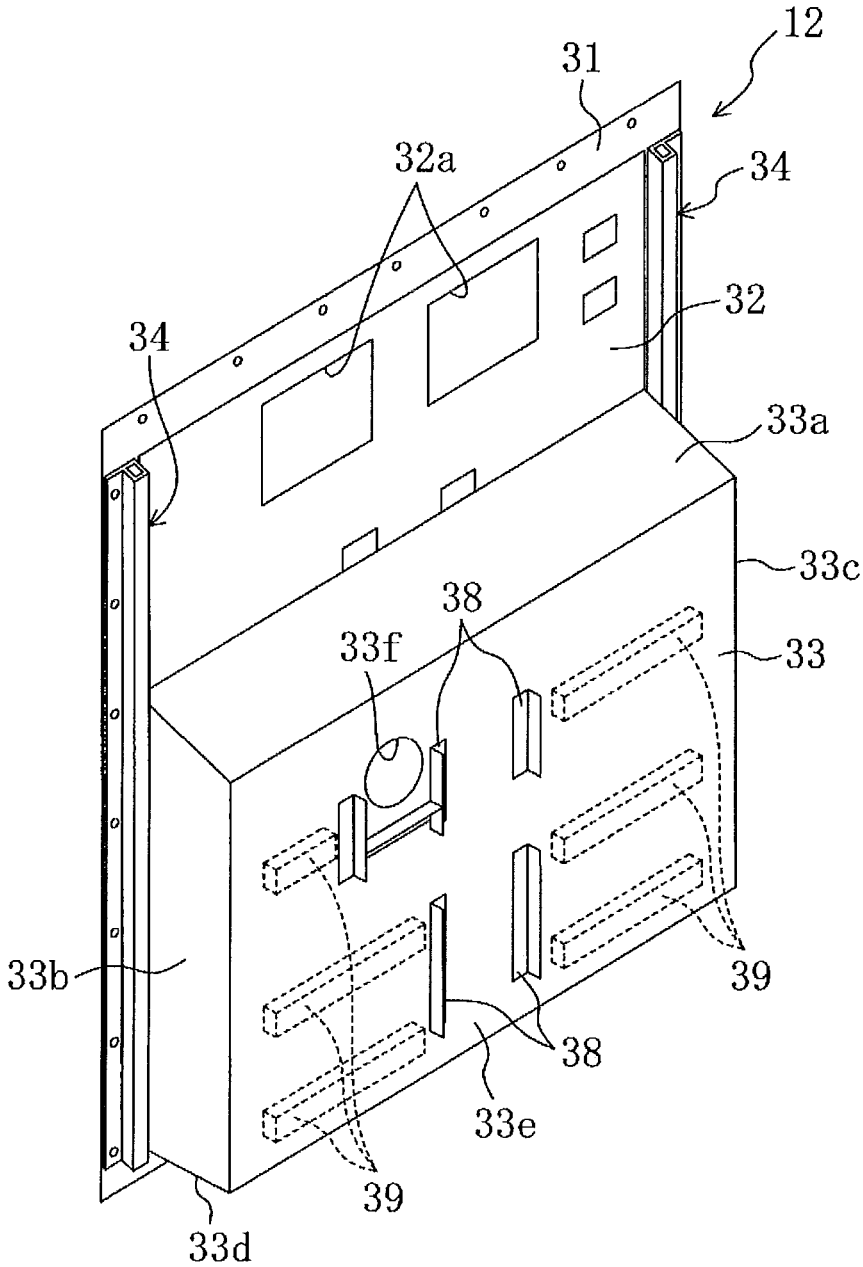
FIG. 4 is an oblique view of an external casing, viewed from the container interior side.

As shown in FIG. 4, a lower portion of the external casing (12) protrudes into the container interior. The external casing (12) includes an upper portion (32) having an approximately planner shape, a lower protrusion portion (33) which protrudes into the container interior and which has an approximately rectangular parallelepiped shape, and an attachment portion (31) which is located at the outer periphery of the external casing (12) so as to surround the upper portion (32) and the lower protrusion portion (33) and which has a rectangular shape when viewed from the front. Aluminum alloy flanges (34) (reinforcing members) having a generally P-shaped cross section, described in detail later, are welded to parts of the attachment portion (31) which extend vertically (i.e., at both end portions along the width dimension of the external casing), and the attachment portion (31) is provided with a plurality of holes for bolts (see FIG. 4). Also, aluminum alloy flanges (not shown) having an approximately F-shaped cross section are provided at parts of the attachment portion (31) which extend laterally (i.e., at both end portions in the vertical dimension of the external casing).

This structure allows the external casing (12) to be attached to the periphery of the opening of the container body (1), with the internal casing (13) fixed to the reinforcing members (34) (see FIG. 6), by inserting bolts in the plurality of holes of the attachment portion (31).

Figure 6:
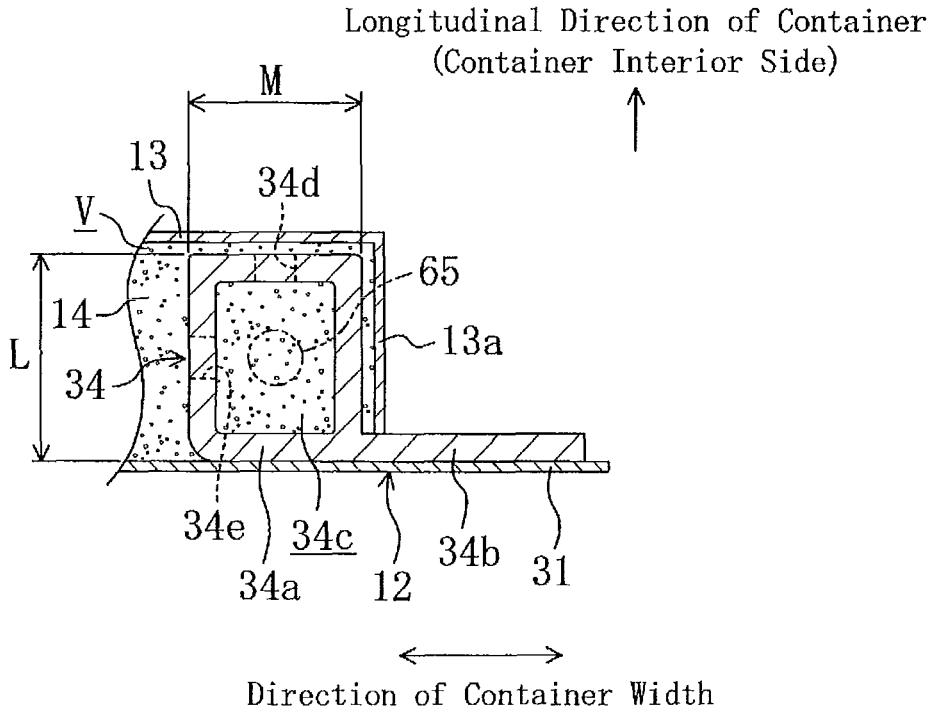
FIG. 6 is a cross-sectional view taken along the line VI-VI of FIG. 5.

As shown in FIG. 6, each of the flanges (34) has a rectangular cylindrical portion (34*a*) having a rectangular cross section, and has a flap portion (34*b*) extending outward such that one side of the rectangular cylindrical portion (34*a*) is elongated, as described in detail later. The flanges (34) therefore have an approximately P-shaped cross section as a whole. The flanges (34) are welded and fixed to the attachment portion (31) such that the rectangular cylindrical portion (34*a*) and the flap portion (34*b*) come in contact with the attachment portion (31) of the external casing (12), and the outer periphery of the internal casing (13) is positioned on the flap portion (34*b*). The rectangular cylindrical portion (34*a*) and the flap portion (34*b*) are welded and fixed to the external casing (12) in the manner as described above, and thereby, the flanges (34) can be fixed more firmly to the external casing (12). Also, the flanges (34) attached to the external casing (12) in the manner as described above can reinforce a greater part of the external casing (12).

The provision of the flanges (34) to the external casing (12) can increase the stiffness of the external casing (12). Also, as shown in FIG. 6, a foaming agent space (V) corresponding to the rectangular cylindrical portion (34*a*) can be formed in a space between the internal casing (13) and the external casing (12).

As shown in FIG. 4, the upper portion (32) of the external casing (12) is continuous with the upper side of the lower protrusion portion (33), and is provided with two openings (32*a*, 32*a*) as view windows at locations close to the upper end. Specifically, each of these openings (32*a*, 32*a*) has a generally rectangular shape, and the openings (32*a*, 32*a*) formed in the upper portion (32) are arranged next to each other in a lateral direction. The openings (32*a*, 32*a*) formed in the upper portion (32) and the openings formed in the internal casing (13) together constitutes the view windows (27), as described later.

The lower protrusion portion (33) includes an upper surface portion (33*a*), two side surface portions (33*b*, 33*c*), a lower surface portion (33*d*), and a bottom surface portion (33*e*). Specifically, each of the upper surface portion (33*a*), the lower surface portion (33*d*), and the bottom surface portion (33*e*) has a generally rectangular shape, while the side surface portions (33*b*, 33*c*) have a generally trapezoidal shape with its one leg inclined. Thus, as shown in FIG. 4, the lower protrusion portion (33) includes the upper surface portion (33*a*), the side surface portions (33*b*, 33*c*), the lower surface portion (33*d*), and the bottom surface portion (33*e*) connected to each other to form a box-like shape, in which the upper surface portion (33*a*) is inclined downward to the lower side of the container.

Further, the bottom surface portion (33*e*) is provided with a hole (33*f*) to avoid interference with a motor (not shown) of the external fan (24) accommodated in the external accommodation space (S1).

Further, as shown in FIG. 1, the lower surface portion (33*d*) is made of a plate member whose thickness is greater than the other part of the external casing (12), because the compressor (21) is placed on the lower surface portion (33*d*). This means that it is possible to reduce, for reduction in weight, a thickness of part of external casing (12) other than the lower surface portion (33*d*) (e.g., the thickness can be reduced from 3.5 mm to 3.3 mm). However, if the thickness of the lower surface portion (33*d*) is reduced like the other part of the external casing (12), fatigue resistance of the portion at which the lower surface portion (33*d*) and the other part of the external casing (12) are welded is significantly reduced because high cycle fatigue is caused at the welded portion due to vibrations of the compressor (21). Therefore, the thickness of the lower surface portion (33*d*) needs to be greater than the thickness of the other part of the external casing (12) (e.g., the thickness remains 3.5 mm). For example, if the thickness of the lower surface portion (33*d*) is reduced from 3.5 mm to 3.3 mm, the stress that should be considered in relation to high cycle fatigue will quadruple.

Figure 5:
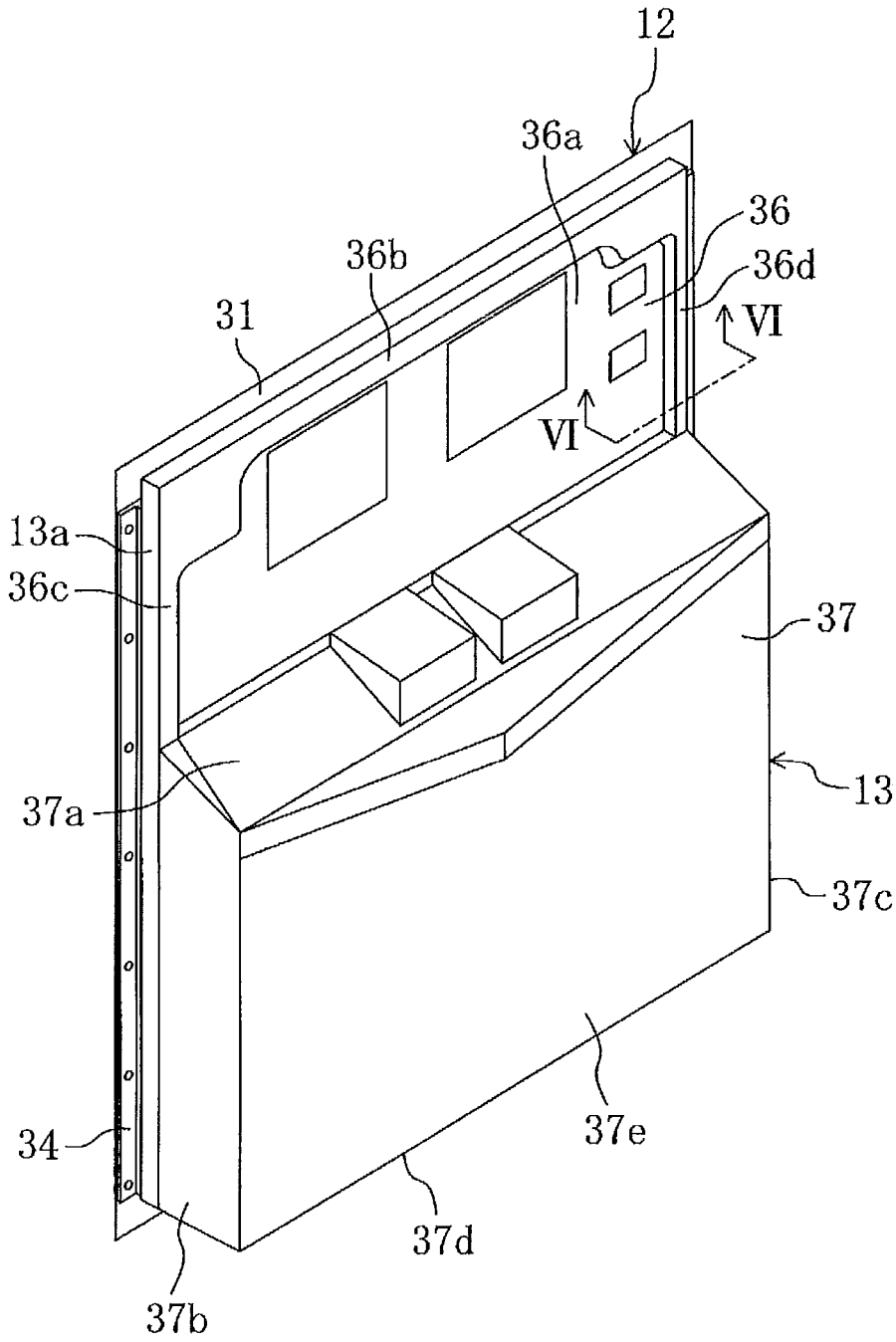
FIG. 5 is an oblique view of a casing which includes the external casing and an internal casing covering the container interior side of the external casing, viewed from the container interior side.

As shown in FIG. 5, the internal casing (13) follows the shape of the external casing (12), and has a lower cover portion (37) which protrudes into the container interior so as to correspond to the external casing (12), and has a flat plate-like upper cover portion (36). The lower cover portion (37) and the upper cover portion (36) are integrally formed with each other. The upper cover portion (36) is continuous with the upper side of the lower cover portion (37).

The upper cover portion (36) includes a cover body (36*a*), and a top frame (36*b*) and side frames (36*c*, 36*d*) arranged so as to form a generally C-shape and surround the cover body (36*a*). The top frame (36*b*) and the side frames (36*c*, 36*d*) are located on the upper side and the lateral sides of the cover body (36*a*), respectively, and the side frames (36*c*, 36*d*) extend downward from the both ends of the top frame (36*b*) to form a generally C-shape as a whole. Further, the top frame (36*b*) and the side frames (36*c*, 36*d*) slightly project into the container interior from the cover body (36*a*). The cover body (36*a*) is provided with two openings for view windows which correspond to the openings (32*a*) in the upper portion (32) of the external casing (12).

The shape of the lower cover portion (37) is approximately the same as the shape of the lower protrusion portion (33) of the external casing (12). The lower cover portion (37) includes an upper surface portion (37*a*), two side surface portions (37*b*, 37*c*), a lower surface portion (37*d*), and a bottom surface portion (37*e*). The lower cover portion (37) is slightly bigger than the lower protrusion portion (33) of the external casing (12) so that the lower cover portion (37) can cover the lower protrusion portion (33) from the container interior side.

Figure 8:
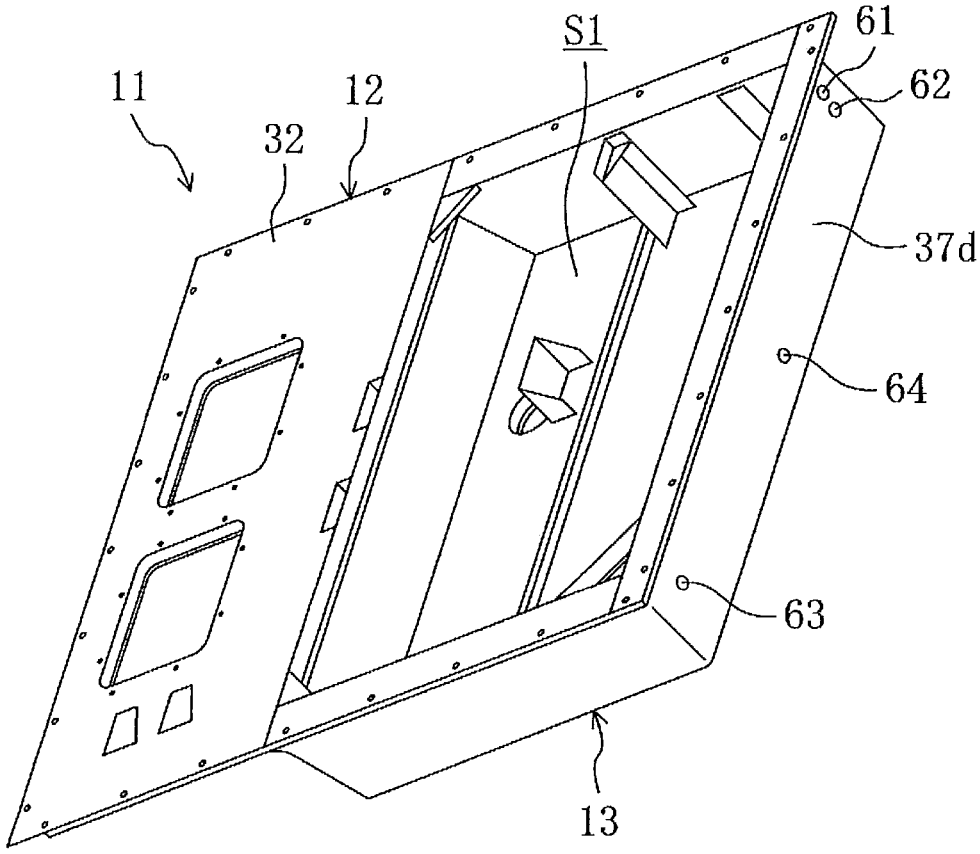
FIG. 8 is an oblique view for illustrating the position of the casing when a foaming agent is injected into a forming agent space.

The lower surface portion (37*d*) is provided with a plurality of injection openings (61, 62, 63) through which an injection hose (65) for injecting a foaming agent (60) into a space (V) (a foaming agent space) between the external casing (12) and the internal casing (13) can be inserted. Specifically, as shown in FIG. 8, the lower surface portion (37*d*) is provided with a first injection opening (61) at a location corresponding to the interior space (34*c*) of the rectangular cylindrical portion (34*a*) of the flange (34), and is provided with second and third injection openings (62, 63) at both end portions of the lower surface portion (37*d*) along the dimension of the container width which directly communicate with the foaming agent space (V). Specifically, the second injection opening (62) is provided at a location close to the first injection opening (61), and the third injection opening (63) is provided at a location opposed to the first injection opening (61) along the width dimension of the container. The first injection opening (61) is positioned closer to the external casing (12) than the second and third injection openings (62, 63).

The provision of the plurality of injection openings (61, 62, 63) in the lower surface portion (37*d*) of the internal casing (13) along the width dimension of the container enables the foaming agent (60) to be more uniformly injected into the space (V) (a foaming agent space) between the external casing (12) and the internal casing (13). In FIG. 8, a through opening (64) is formed at a middle portion of the lower surface portion (37*d*) along the dimension of the container width, for releasing the air when the space is filled with the foaming agent (60).

As shown in FIG. 6, the outer periphery portion (13*a*) of the internal casing (13) is bent toward the exterior of the container (toward the external casing). The outer periphery of the internal casing (13) is positioned on the flap portion (34*b*) of the flange (34) when the internal casing (13) is attached to the external casing (12).

Thus, when the internal casing (13) is attached to the external casing (12), the upper cover portion (36) covers the container interior side of the upper portion (32), and the lower cover portion (37) covers the container interior side of the lower protrusion portion (33), such that the foaming agent space (V) as a thermal barrier (14) is formed between the external casing (12) and the internal casing (13). The foaming agent (60) is injected into the foaming agent space (V) through the injection openings (61, 62, 63) of the internal casing (13), and is foamed to form a thermal barrier (14) as shown in FIG. 2.

Here, as shown in FIG. 4, the container interior side of the external casing (12) is provided with L-shaped reinforcing members (38, 38, . . . ) (second reinforcing members) having an L-shaped cross section and extending vertically so as to face the foaming agent space (V). Specifically, the L-shaped reinforcing members (38, 38, . . . ) are formed at a middle portion of a lower part of the container interior side of the external casing (12) along the dimension of the container width, such that two pairs of the L-shaped reinforcing members (38, 38, . . . ), each pair including two generally parallel L-shaped reinforcing members (38, 38, . . . ), are arranged one above the other. Each L-shaped reinforcing member (38) is welded and fixed to the external casing (12) such that one outer surface of the L-shaped reinforcing member (38) comes into contact with the container interior side of the external casing (12), wherein the projection height of the L-shaped reinforcing member (38) is less than the thickness of the foaming agent space (V). That is, the L-shaped reinforcing members (38, 38, . . . ) are provided such that a space is left between each of the L-shaped reinforcing members (38, 38, . . . ) and the internal casing (13). With this structure, the stiffness of the external casing (12) in a vertical direction can be increased, and the L-shaped reinforcing members (38, 38, . . . ) do not interrupt the filling of the foaming agent space (V) with the foaming agent (60).

Further, a plurality of wooden frames (39, 39, . . . ) are disposed in the foaming agent space (V) such that the wooden frames (39, 39, . . . ) are sandwiched between the external casing (12) and internal casing (13). Specifically, as shown in broken lines in FIG. 4, the wooden frames (39, 39, . . . ) are disposed at both end portions of a lower part of the external casing (12) along the width dimension. Each end portion is provided with three wooden frames (39, 39, . . . ) which extend in the left-to-right direction and which are arranged parallel to each other. These wooden frames (39, 39, . . . ) are placed on opposing sides of the L-shaped reinforcing members (38, 38, . . . ) along the width dimension of the container. Of these wooden frames (39, 39, . . . ), a wooden frame (39) located close to the hole (33*f*) formed in the bottom surface portion (33*e*) of the lower protrusion portion (33) of the external casing (12) has a length shorter than the lengths of the other wooden frames. This structure enables the wooden frames (39, 39, . . . ) to have a simplified shape, compared to the case in which part of the wooden frame (39) has a reduced thickness to avoid interference with reinforcing members provided adjacent to the hole (33*f*). As a result, fabrication costs can be reduced.

A force applied to the internal casing (13) can be transferred to the external casing (12) by the wooden frames (39, 39, . . . ) provided in the manner as described above. Even if such the force is transferred to the external casing (12) from the internal casing (13), deformation of the external casing (12) can be prevented because the stiffness of the external casing (12) is increased by the L-shaped reinforcing members (38, 38, . . . ).

For example, one such force may be an impact load which is applied to the casing (11) of the container refrigeration unit (10) by goods in the container which have shifted toward the container refrigeration unit (10) because of such as hard braking during the transportation of the container (C) by a truck, etc.

As described in the above, the side stays (40), the frame support member (43), and the partition plate support members (44), which support the partition plate (50), are connected and fixed to the container interior side of the internal casing (13). Therefore, the impact load applied to the partition plate (50) is transferred to the internal casing (13) via the side stays (40), the frame support member (43), and the partition plate support members (44). The impact load is then transferred to the external casing (12) via the wooden frames (39). Here, the external casing (12) is reinforced by the L-shaped reinforcing members (38, 38, . . . ), and therefore, deformation of the external casing (12) is prevented. In other words, the strength of the end wall of the casing (11) of the container refrigeration unit (10) can be increased by the above structure.

—Structure of Flange—

Next, a structure of the flange (34) will be described in detail hereinafter.

As mentioned earlier, the flange (34) includes the rectangular cylindrical portion (34*a*) having a rectangular cross section and the flap portion (34*b*) extending outward such that one side of the rectangular cylindrical portion (34*a*) is elongated, and therefore the reinforcing members (34) has a generally P-shaped cross section. The rectangular cylindrical portion (34*a*) having the above cross section can increase bending stiffness of the external casing (12) in the vertical direction. That is, the rectangular cylindrical portion (34*a*) of the flange (34) extending in the vertical direction can prevent the external casing (12) from being significantly deformed and damaged even when a vertical bending moment is applied to the external casing (12).

Figure 7:
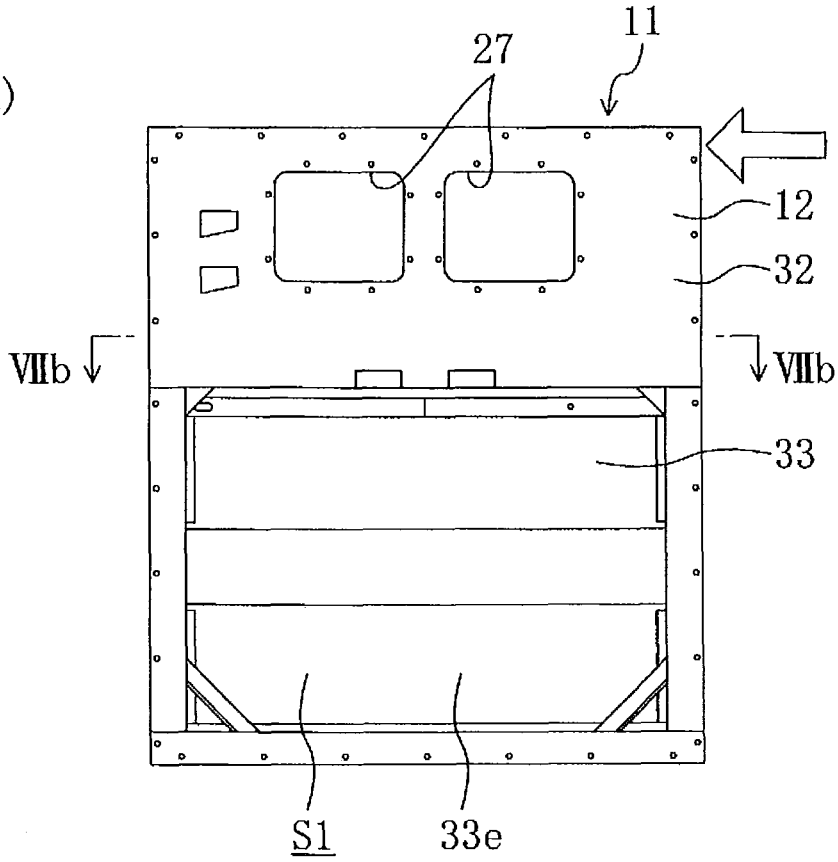
FIG. 7A is a plan view from the container exterior side, for illustrating a location of the casing to which a load is applied during testing.
FIG. 7B is a cross-sectional view taken along the line VIIb-VIIb of FIG. 7A.
Figure 7:
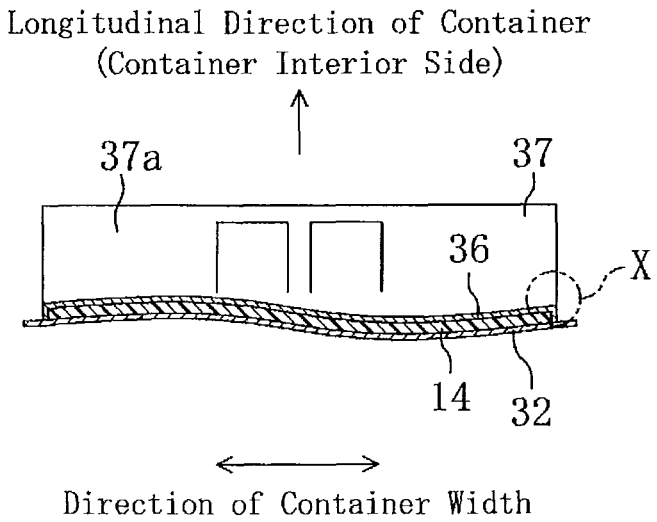

In general, a force that may cause a shear deformation is applied to the stacked containers (C) when, for example, the ship leans to one side. Thus, as a product test that simulates such the situation, a test is performed in which a force greater than an actual force is applied to a corner of the container (C) to cause a shear deformation of the container (C) and check the strength of the container (C) when the shear deformation is caused. In such the test, particularly in the case where a force is applied to two corners on the same side of the container (C), a great force acts on the casing (11) of the container refrigeration unit (10) located at the open end of the container body (1). That is, in such the test, a force in the direction of the container width is applied to only the upper portion of the casing (11) as shown in FIG. 7A, which results in a wave-like deformation of the plate-like upper portion of the casing (11) in the direction orthogonal to the plane, as shown in FIG. 7B. In such the case, a similar wave-like deformation also occurs in the internal casing (13) made of an FRP. Therefore, stress is concentrated on the corner portion (X) between the upper cover portion (36) and the lower cover portion (37) of the internal casing (13) (in particular, a corner of the lower cover portion (37) when viewed from the container interior side), and as a result, the corner may be damaged depending on the load applied in the test.

In view of the above, as a characteristic feature of the present invention, the length L of the rectangular cylindrical portion (34*a*) of the flange (34) along the longitudinal dimension of the container is longer than the length M of the rectangular cylindrical portion (34*a*) of the flange (34) along the width dimension of the container, as shown in FIG. 6. With this structure, stiffness of the rectangular cylindrical portion (34*a*) in the longitudinal direction of the container can be increased, and the bending stiffness of the flange (34) in the vertical direction (longitudinal direction) can be increased. Since the flange (34) can increase the bending stiffness of the external casing (12) in the vertical direction, local deformation or damage of the internal casing (13) due to stress partially concentrated on the casing (11) of the container refrigeration unit (10) can be prevented even if the container (C) is deformed and sheared as described in the above.

As shown in FIG. 6, the length L of the rectangular cylindrical portion (34*a*) of the flange (34) along the longitudinal dimension of the container is approximately the same as the height of the outer periphery portion (13*a*), i.e., the bent portion of the internal casing (13). Thus, the rectangular cylindrical portion (34*a*) is close to the interior surface of the internal casing (13) in the state in which the internal casing (13) is attached to the external casing (12).

Here, according to this embodiment, sides of the rectangular cylindrical portion (34*a*) have approximately the same thickness, except the one side along which the flap portion (34*b*) extends. Thus, the interior space (34*c*) of the rectangular cylindrical portion (34*a*) as well has a cross section whose dimension along the longitudinal dimension of the container is greater than the dimension of the cross section along the width dimension of the container. The interior space (34*c*) of the rectangular cylindrical portion (34*a*) is of a size which allows the injection hose (65) for injecting the foaming agent (60) into the interior space (34*c*) to be inserted therein, as described later.

On the other hand, the flap portion (34*b*) and the one side of the rectangular cylindrical portion (34*a*) along which the flap portion (34*b*) extends have a thickness greater than the other sides of the rectangular cylindrical portion (34*a*). With this structure, stiffness of the casing (11) can be increased not only by the rectangular cylindrical portion (34*a*), but also by the flap portion (34*b*).

Figure 9:
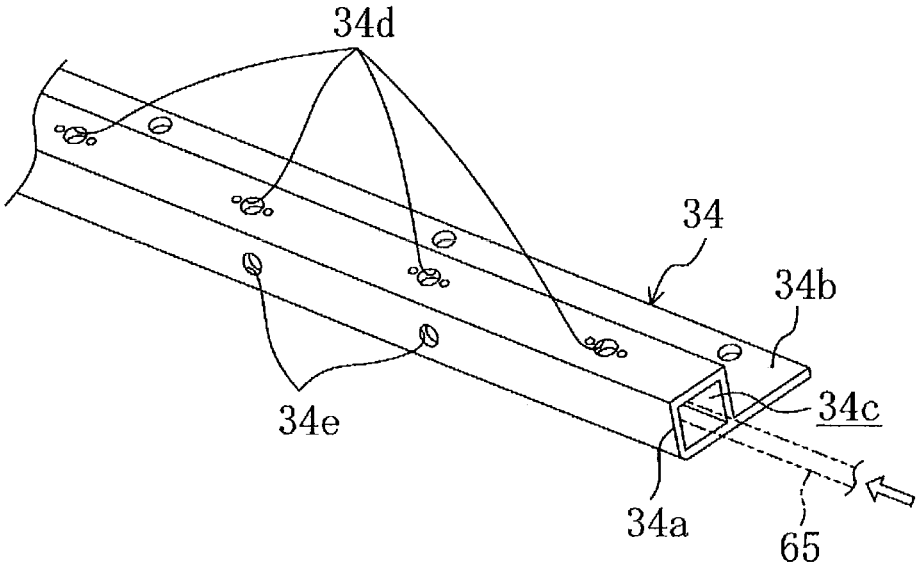
FIG. 9 is an oblique view of a flange, viewed from the container interior side.

As shown in FIG. 6 and FIG. 9, among the sides of the rectangular cylindrical portion (34*a*), the side (the upper side in the respective drawings) opposed to the side along which the flap portion (34*b*) extends and the side (the left side in the respective drawings) located in a direction opposite to the direction along which the flap portion (34*b*) extends, are provided with a plurality of through holes (34*d*, 34*e*) along a longitudinal dimension. In other words, in the state in which the flange (34) is attached to the external casing (12) (the state as shown in FIG. 6), the through holes (34*d*, 34*e*) are respectively formed in the side of the rectangular cylindrical portion (34*a*) that is on the container interior side, and in the side of the rectangular cylindrical portion (34*a*) that is located closer to the middle of the container along the dimension of the container width. These through holes (34*d*, 34*e*), as described later, allow the foaming agent (60), which is injected by inserting the injection hose (65) into the rectangular cylindrical portion (34*a*), to overflow from the interior space (34*c*) of the rectangular cylindrical portion (34*a*) through the through holes (34*d*, 34*e*) into the foaming agent space (V). Therefore, the foaming agent space (V) can be filled with the foaming agent (60) through the interior space (34*c*) of the rectangular cylindrical portion (34*a*). In particular, the provision of the through holes (34*e*) in the side of the rectangular cylindrical portion (34*a*) that is located closer to the middle of the container along the width dimension of the container allows the foaming agent (60) to easily move toward the middle of the foaming agent space (V) along the width dimension of the container. As a result, the foaming agent space (V) can be efficiently filled with the foaming agent (60).

—Method for Forming Casing—

A method for forming the casing (11) having the above-described structure will be described hereinafter. To form the casing (11), the external casing (12) and the internal casing (13) are attached to each other, and in this state, each hole or the like is sealed. Then, the foaming agent (60) is injected into a foaming agent space (V) between the casings (12, 13) by using the injection hose (65), and the foaming agent (60) is foamed.

Specifically, first, the internal casing (13) made of a resin (FRP) is formed by press or the like, and the external casing (12) made of an aluminum alloy is formed by the welding of aluminum parts, for example. Each of the casings (12, 13) is subjected to various kinds of working, such as formation of holes, and the flanges (34) are welded to the attachment portion (31) of the external casing (12).

Then, holes and gaps of the external casing (12) and internal casing (13) are sealed with a sealing material. After that, the external casing (12) and the internal casing (13) are attached to each other. At this time, the outer periphery portion (13*a*) of the internal casing (13) is positioned on the flanges (34) of the external casing (12) (see FIG. 6). Although not specifically shown, the joint between the external casing (12) and the internal casing (13) is also sealed by applying a sealing material.

The external casing (12) and the internal casing (13) attached to each other are laid down such that the upper portion of the casings (12, 13) is placed in a lower location than the lower portion of the casings (12, 13). Among the plurality of injection openings (61, 62, 63) formed in the lower surface portion (37*d*) of the lower cover portion (37) of the internal casing (13), the injection hose (65) is inserted in the first injection opening (61) corresponding to the interior space (34*c*) of the rectangular cylindrical portion (34*a*) of the flange (34). Here, the injection hose (65) is inserted to a location in the interior space (34*c*) that corresponds to the upper portion of the casing (11) (see FIG. 9), and at that location, the foaming agent (60) is injected into the interior space (34*c*) through the injection hose (65). Here, the foaming agent (60) is preferentially injected into the interior space (34*c*) of the rectangular cylindrical portion (34*a*), into which it is difficult to inject the foaming agent (60) from the outside of the rectangular cylindrical portion (34*a*), and the foaming agent (60) overflows into the foaming agent space (V) through the through holes (34*d*, 34*e*) formed at an end portion of the rectangular cylindrical portion (34*a*) and a side surface of the rectangular cylindrical portion (34*a*). This structure allows the injection hose (65) to be reliably and easily inserted into the casing, using the rectangular cylindrical portion (34*a*) as a guide, and allows the rectangular cylindrical portion (34*a*) and the foaming agent space (V) to be thoroughly and reliably filled with the foaming agent (60).

For the efficient and reliable filling of the foaming agent (60), it is preferable that the location of the injection hose (65) in the interior space (34*c*) is changed according to a period of injection time or an amount of injection of the foaming agent (60).

After injecting the foaming agent (60) through the injection hose (65) for a certain period of time (or a certain amount), the injection hose (65) is taken from the first injection opening (61) and is inserted into the second injection opening (62) near the first injection opening (61). The second injection opening (62) directly communicates with the foaming agent space (V), and therefore, the foaming agent space (V) can be efficiently filled with the foaming agent (60) injected through the injection hose (65) inserted into the second injection opening (62).

After injecting the foaming agent (60) from the second injection opening (62) in the above-described manner for a certain period of time (or a certain amount), the injection hose (65) is taken from the second injection opening (62) and is inserted into the third injection opening (63) provided at a opposite location along the width dimension of the container. The third injection opening (63) as well directly communicates with the foaming agent space (V), and therefore, the foaming agent space (V) can be efficiently and reliably filled with the foaming agent (60) from the opposite side of the foaming agent space (V) along the width dimension of the container. The filling of the foaming agent (60) from the third injection opening (63) is continued until the foaming agent (60) overflows from the air through opening (64) formed in the lower surface portion (37*d*) of the internal casing (13).

After filling the foaming agent space (V) with the foaming agent (60) in the above-described manner, the foaming agent (60) is foamed to form the thermal barrier (14).

—Operational Behavior—

Operation of the container refrigeration unit (10) is started by actuation of the compressor (21), the external fan (24) and the interior fans (26). In the refrigerant circuit of the container refrigeration unit (10), a refrigerant discharged from the compressor (21) is transferred to the condenser (23). In the condenser (23), heat is exchanged between the refrigerant circulating in the condenser (23) and the air outside the container that is supplied by the external fan (24). As a result, heat of the refrigerant is transferred to the air outside the container, and the refrigerant is condensed.

The refrigerant condensed by the condenser (23) is depressurized by an expansion valve, and is then transferred to the evaporator (25). In the evaporator (25), heat is exchanged between the refrigerant circulating in the evaporator (25) and the air inside the container that is supplied by the interior fans (26). As a result, the refrigerant absorbs heat from the air inside the container and evaporates, and the air inside the container is cooled. As shown in FIG. 2, the air inside the container flows into the internal accommodation space (S2) from the upper side of the partition plate (50), and passes through the evaporator (25). The air inside the container is cooled by the evaporator (25), and is then returned to the container interior from the lower side of the partition plate (50). The refrigerant evaporated by the evaporator (25) is drawn into the compressor (21) and is compressed again.

Effects of Embodiment

As described in the above, according to the present embodiment, the flange (34) having the rectangular cylindrical portion (34*a*) whose length L along the longitudinal dimension of the container is longer than the length M along the width dimension of the container is welded and fixed to the attachment portion (31) of the external casing (12), and therefore, bending stiffness of the external casing (12) in the vertical direction can be increased by the rectangular cylindrical portion (34*a*) whose stiffness in the longitudinal direction of the container is high. This structure can prevent local deformation or damage of part of the internal casing (13) made of an FRP due to great stress partially concentrated on the casing (11) of the container refrigeration unit (10) located at the open end of the container body (1), even in a test in which a force is applied to two corners on the same side of the container (C) to cause a shear deformation of the container (C).

Moreover, the flange (34) is a member having a generally P-shaped cross section, in which the rectangular cylindrical portion (34*a*) and the flap portion (34*b*) continuously extending from one side of the rectangular cylindrical portion (34*a*) are integrally formed. Because the rectangular cylindrical portion (34*a*) and the flap portion (34*b*) are joined to the external casing (12), the flange (34) can be firmly attached to the external casing (12), and the stiffness of greater part of the external casing (12) can be increased not only by the rectangular cylindrical portion (34*a*), but also by the flap portion (34*b*).

Further, the rectangular cylindrical portion (34*a*) of the flange (34) is configured such that the injection hose (65) for injecting a forming agent can be inserted into the interior space (34*c*) of the rectangular cylindrical portion (34*a*). Therefore, the rectangular cylindrical portion (34*a*) serves as a guide when the injection hose (65) is inserted through the first injection opening (61), which is formed in the lower surface portion (37*d*) of the lower cover portion (37) of the internal casing (13) so as to correspond to the interior space (34*c*), and allows the injection hose (65) to be reliably and easily inserted in the interior space (34*c*) to inside the casing. In addition, the interior space (34*c*) of the rectangular cylindrical portion (34*a*) is filled with the foaming agent (60) first, and therefore, the interior space (34*c*), the filling of which with the foaming agent (60) from outside the rectangular cylindrical portion (34*a*) is difficult, can be thoroughly and reliably filled with the foaming agent (60). Moreover, the rectangular cylindrical portion (34*a*) is provided with the through holes (34*d*, 34*e*) formed in the surface on the container interior side and in the surface located closer to the middle of the container along the dimension of the container width, for allowing the foaming agent (60) to pass through. Therefore, the foaming agent space (V) can be efficiently filled with the foaming agent (60) through the through holes (34*d*, 34*e*).

Further, in order to fill the foaming agent space (V) with the foaming agent (60), the foaming agent (60) is injected not only through the first injection opening (61), but also through the second and third injection openings (62, 63) in sequence, which are formed in the lower surface portion (37*d*) of the internal casing (13) along the width dimension of the container and which directly communicate with the foaming agent space (V). As a result, the foaming agent space (V) can be thoroughly filled with the foaming agent (60) with reliability.

Further, in order to fill the foaming agent space (V) with the foaming agent (60), the casings (12, 13) are laid down such that the upper portions of the external casing (12) and the internal casing (13) are placed in a lower location than the lower portions of the external casing (12) and the internal casing (13). Therefore, the foaming agent space (V) can be thoroughly filled with the foaming agent (60) with reliability.

Further, the middle portion of the external casing (12) along the width dimension of the container is provided with two pairs of L-shaped reinforcing members (38, 38, . . . ) having a generally L-shaped cross section, each pair including vertically extending L-shaped reinforcing members (38, 38, . . . ) arranged parallel to each other. Stiffness of the external casing (12) can thus be increased. With this structure, the external casing (12) can be prevented from being significantly deformed even when a force is applied to the casing (11) of the container refrigeration unit (10) by goods in the container (C) which have shifted to one side because of such as hard braking during the transportation of the container (C) by a truck, etc. In addition, the L-shaped reinforcing members (38, 38, . . . ) are configured such that space is left between the L-shaped reinforcing members (38, 38, . . . ) and the internal casing (13), and are formed to have a generally L-shaped cross section as described in the above. Therefore, flow of the foaming agent (60) in the foaming agent space (V) is not interrupted, compared to the case in which the L-shaped reinforcing members (38, 38, . . . ) have a generally C-shaped cross section. With the above structure, the strength of the external casing (12) can be increased, and at the same time, the foaming agent space (V) can be filled with the foaming agent (60) with improved ease.

Other Embodiments

The following structures may also be used in the above-described embodiment.

In the above embodiment, the injection openings (61, 62, 63) are formed in the lower surface portion (37*d*) of the lower cover portion (37) of the internal casing (13). However, the structure is not limited to this structure, but the injection openings may be formed in other locations of the internal casing (13). In this case as well in which the injection openings are formed in other locations of the internal casing (13), it is preferable that the external casing (12) and the internal casing (13) are positioned such that the injection openings are located at an uppermost position, when the foaming agent (60) is injected in the foaming agent space (V).

Further, in the above embodiment, only one injection opening (61) of the three injection openings (61, 62, 63) foamed in the lower surface portion (37*d*) of the internal casing (13) corresponds to the interior space (34*c*) of the flange (34). However, the structure is not limited to this structure, but injection openings which correspond to the interior space (34*c*) of the respective flanges (34, 34) attached at both end portions of the external casing (12) along the width dimension of the container, may be formed at both end portions of the lower surface portion (37*d*) along the width dimension of the container.

INDUSTRIAL APPLICABILITY

As described in the above, the present invention relates to container refrigeration units for cooling the interior of a container, and is particularly useful as a measure for increasing the strength of the casing of the container refrigeration unit.

The invention claimed is:

1. A container refrigeration unit, comprising: an external casing whose periphery is fixed to a container body to close an open end of the container body; and an internal casing which covers a container interior side of the external casing such that a foaming agent space, in which a foaming agent is foamed, is formed between the external casing and the internal casing, wherein reinforcing members which extend vertically and which are located at both end portions of the external casing along a dimension of a container width are provided at a location that is between the external casing and the internal casing and that is on the container interior side of the external casing, each of the reinforcing members has a rectangular tube-like portion extending vertically along the external casing and having a rectangular cross section, and the rectangular tube-like portion is configured to have a cross section whose length along a longitudinal dimension of the container is longer than a length of the cross section along the width dimension of the container.

2. The container refrigeration unit according to claim 1, wherein each reinforcing member has a generally P-shaped cross section in which one side of the rectangular tube-like portion is elongated, and the reinforcing member is fixed to the external casing such that the elongated side comes in contact with a surface of the external casing on the container interior side.

3. The container refrigeration unit according to claim 1, wherein the rectangular tube-like portion is configured such that an injection hose for injecting a foaming agent can be inserted into the rectangular tube-like portion, and a side surface of the rectangular tube-like portion is provided with through holes which allow the foaming agent to pass through at the time of filling of the foaming agent space with the foaming agent.

4. The container refrigeration unit according to claim 1, wherein a second reinforcing member having a generally L-shaped cross section is provided at a middle portion of the container interior side of the external casing along the dimension of the container width.

* * * * *